US012790827B2

(12) United States Patent
Striebel et al.

(10) Patent No.: US 12,790,827 B2
(45) Date of Patent: Nov. 10, 2026

(54) VERTICAL CABLE RAILING SYSTEM

(71) Applicant: Suncor Stainless Inc., Plymouth, MA (US)

(72) Inventors: Patrick Striebel, Duxbury, MA (US); James Storrer, Middleboro, MA (US); David Dion, Marion, MA (US)

(73) Assignee: Suncor Stainless Inc.

( * ) Notice: Subject to any disclaimer, the term of this patent is extended or adjusted under 35 U.S.C. 154(b) by 216 days.

(21) Appl. No.: 18/653,731

(22) Filed: May 2, 2024

(65) Prior Publication Data

US 2024/0368896 A1 Nov. 7, 2024

Related U.S. Application Data

(60) Provisional application No. 63/464,423, filed on May 5, 2023.

(51) Int. Cl.
*E04F 11/18* (2006.01)

(52) U.S. Cl.
CPC ..... *E04F 11/1859* (2013.01); *E04F 11/1817* (2013.01); *E04F 2011/1821* (2013.01); *E04F 2011/1827* (2013.01)

(58) Field of Classification Search
CPC ... E01F 15/06; E04F 11/1812; E04F 11/1817; E04F 11/1859; E04F 2011/1821; E04F 2011/1823; E04F 2011/1825; E04F 2011/1827; E04F 2011/1829; E04H 17/02; E04H 17/04; E04H 17/055; E04H 17/06; E04H 17/127; F16G 11/12
USPC ..... 256/32, 34, 37, 47
See application file for complete search history.

(56) References Cited

U.S. PATENT DOCUMENTS

| | | | | |
|---|---|---|---|---|
| 2,463,144 | A | 3/1949 | Buchanan | |
| 3,278,210 | A | 10/1966 | Sanders | |
| 3,652,049 | A | 3/1972 | McCown et al. | |
| 3,895,879 | A | 7/1975 | Burtelson | |
| 3,960,359 | A | 6/1976 | Svahn et al. | |
| 4,066,368 | A | 1/1978 | Mastalski et al. | |
| 4,594,018 | A | 6/1986 | Larsson et al. | |
| 4,627,762 | A | 12/1986 | Scotti | |
| 4,671,695 | A | 6/1987 | Scotti | |
| 6,249,938 | B1 * | 6/2001 | Heismann | F16G 11/14 403/208 |

(Continued)

FOREIGN PATENT DOCUMENTS

| | | | |
|---|---|---|---|
| DE | 29517079 | U1 | 4/1996 |
| DE | 29915271 | U1 | 12/1999 |
| GB | 2388636 | A | 11/2003 |

OTHER PUBLICATIONS

Product Information for Part 8017, Ram Tail [online] <URL:https://ramtail.com/products/> (2024), 1 page.

*Primary Examiner* — Josh Skroupa
(74) *Attorney, Agent, or Firm* — ArentFox Schiff LLP

(57) ABSTRACT

A vertical infill railing assembly includes an upper support handrail member. The upper support handrail member receives and supports one or more vertical infill cables and one or more baluster members. The assembly includes a lower support handrail member. The lower support handrail member receives and supports the one or more vertical infill cables and the one or more baluster members. The assembly also includes one or more tensioning devices. The one or more tensioning devices receive and tension the one or more vertical infill cables.

20 Claims, 13 Drawing Sheets

(56) References Cited

U.S. PATENT DOCUMENTS

| | | | | |
|---|---|---|---|---|
| 7,198,253 | B2 | 4/2007 | Striebel et al. | |
| 8,992,116 | B2 * | 3/2015 | Sloan | E04H 17/04 256/13.1 |
| 9,689,410 | B2 * | 6/2017 | Østervig | E04F 11/1859 |
| 9,790,707 | B2 * | 10/2017 | Burt | E04F 11/1859 |
| 10,883,290 | B2 * | 1/2021 | Burt | E04F 11/1859 |
| 11,230,843 | B2 * | 1/2022 | Kennedy | E04F 11/1859 |
| 11,300,180 | B2 * | 4/2022 | Graber | E04F 11/1859 |
| 11,643,838 | B2 * | 5/2023 | Burt | E04F 11/1859 256/48 |
| 11,732,482 | B2 * | 8/2023 | Burt | E04F 11/1859 256/59 |
| 11,732,776 | B2 * | 8/2023 | Graber | E04F 11/1859 256/67 |
| 12,180,735 | B2 * | 12/2024 | Burt | E04F 11/1859 |
| 2003/0010966 | A1 | 1/2003 | Sjostedt | |
| 2003/0178611 | A1 | 9/2003 | Anderson | |

* cited by examiner

VERTICAL CABLE RAILING SYSTEM

CROSS REFERENCE TO RELATED APPLICATIONS

The present application claims the benefit of provisional application No. 63/464,423, filed May 5, 2023.

FIELD OF TECHNOLOGY

The present disclosure is in the field of railing systems, and in particular, railing systems with vertical infill for applications, such as decks and other areas, that require a guardrail support mechanism.

BACKGROUND

Railing systems provide structural assemblies to provide edge support or fencing to create a protective restraining border. They primarily consist of two or more vertical posts mounted to a surface with a horizontal upper and lower support rail. Infill members consisting of vertical cables or other vertical baluster type members create a safety fence. The railing system typically mounts near the edge of deck or other type of walkway requiring a safety restraining support. The railing systems can also mount near the edges of stairways as well with similar vertical posts, upper and lower railings, and infill.

SUMMARY

According to one aspect, a vertical infill railing assembly is provided. The assembly includes an upper support handrail member. The upper support handrail member receives and supports one or more vertical infill cables and one or more baluster members. The assembly includes a lower support handrail member. The lower support handrail member receives and supports the one or more vertical infill cables and the one or more baluster members. The assembly also includes one or more tensioning devices. The one or more tensioning devices receive and tension the one or more vertical infill cables.

According to some implementations of the vertical infill railing assembly, two or more posts are also included, which secure the upper support handrail member and lower support handrail member at opposing upper and lower ends of the two or more posts. According to implementations, the upper support handrail member and lower support handrail member are secured at opposing upper and lower ends of the two or more posts via two or more upper brackets and two or more lower brackets.

According to some implementations of the vertical infill railing assembly, the upper support handrail member receives and supports an upper end of the one or more vertical infill cables and an upper end of the one or more baluster members. According to implementations, the upper support handrail member receives and supports an upper end of the one or more vertical infill cables via one or more upper stop sleeves.

According to some implementations of the vertical infill railing assembly, the lower support handrail member receives and supports a lower end of the one or more vertical infill cables and a lower end of the one or more baluster members. According to some implementations, the one or more baluster members are rigidly and vertically compressible to support the tensioning of the one or more vertical infill cables. According to some implementations, the one or more baluster members are installed in one or more respectively opposing slots on the upper support handrail member and lower support handrail member to support the tensioning of the one or more vertical infill cables. According to some implementations, supporting the tensioning of the one or more vertical infill cables prevents bending of the upper support handrail member and lower support handrail member.

According to some implementations of the vertical infill railing assembly, the one or more tensioning devices are disposed within the lower support handrail member. According to some implementations, the one or more tensioning devices tension the one or more vertical infill cables via one or more lower stop sleeves and one or more externally threaded tubes. According to some implementations, the externally threaded tube provides a turnbuckle for tensioning the one or more vertical infill cables. According to some implementations, the externally threaded tube surrounds the one or more lower stop sleeves, which is attached to a lower end of the one or more vertical infill cables. According to some implementations, the externally threaded tube is flat on two or more external sides to provide anti-rotation of the one or more tensioning devices.

According to some implementations of the vertical infill railing assembly, the one or more vertical infill cables have at least one end fitting attached to the upper support handrail member and/or lower support handrail member by welding, gluing, or mechanical attachment. According to some implementations, the one or more vertical infill cables are bonded directly to the one or more stop sleeves.

According to some implementations of the vertical infill railing assembly, the one or more vertical infill cables includes a solid rod. According to some implementations, the upper support handrail member and lower support handrail member include a rigid tubular and/or semi-tubular structural railing.

According to some implementations, the assembly further includes an angular bottom tensioner. In some implementations, the angular bottom tensioner receives and tensions the one or more vertical infill cables when the vertical infill railing system assembly is installed in an inclined environment.

According to another aspect, a vertical infill railing system assembly is provided. The assembly includes an upper support handrail member. The upper support handrail member receives and supports one or more vertical infill cables and one or more baluster members. The assembly includes a lower support handrail member. The lower support handrail member receives and supports the one or more vertical infill cables and the one or more baluster members. The one or more vertical infill cables are bonded directly to the one or more stop sleeves. The assembly includes two or more posts securing the upper support handrail member and lower support handrail member at opposing upper and lower ends of the two or more posts. The upper support handrail member and lower support handrail member are secured at opposing upper and lower ends of the two or more posts via two or more upper brackets and two or more lower brackets. The assembly also includes one or more tensioning devices. The one or more tensioning devices receive and tension the one or more vertical infill cables via one or more lower stop sleeves and one or more externally threaded tubes within the lower support handrail member.

DETAILED DESCRIPTION

Aspects of the present disclosure include a vertical railing assembly. This assembly may include upper and lower railings mounted between two vertical posts. In some embodiments, tensioned infill cables with ends mounted to the upper and lower railings may provide a barrier support fence. These infill cables may include a stop sleeve on one end, and an adjuster on the other end. The assembly may include intermediate rigid infill tubes, which can maintain railing support to resist infill cable tension and prevent railing bending. These cables may include, for example, 1×19, 7×7, and/or 7×19 stranded cables and/or wires, and may include solid rods.

Other railing system fail to develop cable railing assemblies that are economical. For example, these railing assemblies are often complex to manufacture and/or assemble, and can include multiple interacting extrusions. They may include swaged components, which may provide less than optimal strength or durability. A focus on an assembly that is more functional, economically feasible, and easy to install is therefore the focus of the present disclosure. In this way, the assembly of the present disclosure provides an improved vertical infill railing assembly, including welded end fittings.

The railing systems of the present disclosure may resemble standard rigid wooden or metal baluster assemblies. These assemblies and their components may be made of hard plastics or other materials, such as steel or aluminum. In some embodiments, the material can be a corrosion resistant steel. These assemblies may include device which can be attached to a mounting surface by various means, such as, via a mounting plate. For example, the mounting plate may be a flat plane, or include a semi-round contour in order to accommodate one or more mounting surfaces. In some embodiments, the device attaches to various sizes of cable/wire rope opposite a mounting plate, which can impose tension upon the attached cable.

In some embodiments, the mounting surfaces may be rigid, and may include a wooden post, a steel post, a post consisting of other materials. These posts may include square, round, and/or other shapes. The mounting surfaces of the present disclosure also may include a cement, wooden, metal, and/or like material structure. For example, if the device were to be used in a vertical plane, a wooden, steel, or other material, such as plastic, may be utilized as the mounting surface to accommodate the environment, individual preference, or other considerations. In examples, the assembly of the present disclosure may typically be mounted to a deck to serve as a restraining barrier to prevent individuals from falling off a deck and/or platform. Additionally, the vertical infill may prevent individuals from climbing the railing assemblies of the present disclosure, in contrast to horizontal infill assemblies.

Figure 1:
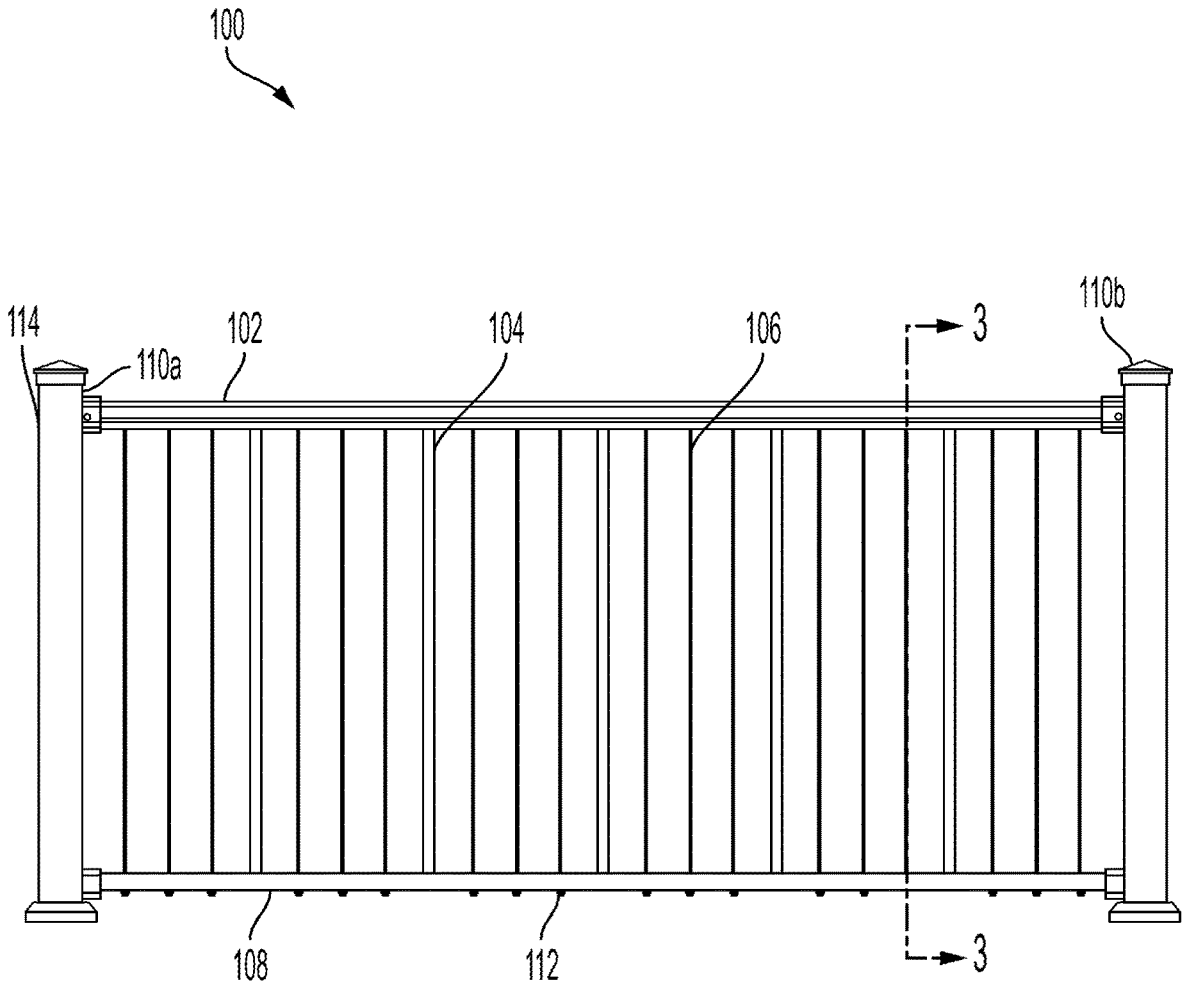
FIG. 1 is an example schematic of a vertical infill railing system/assembly when assembled in a linear environment, according to the present disclosure.
Figure 2:
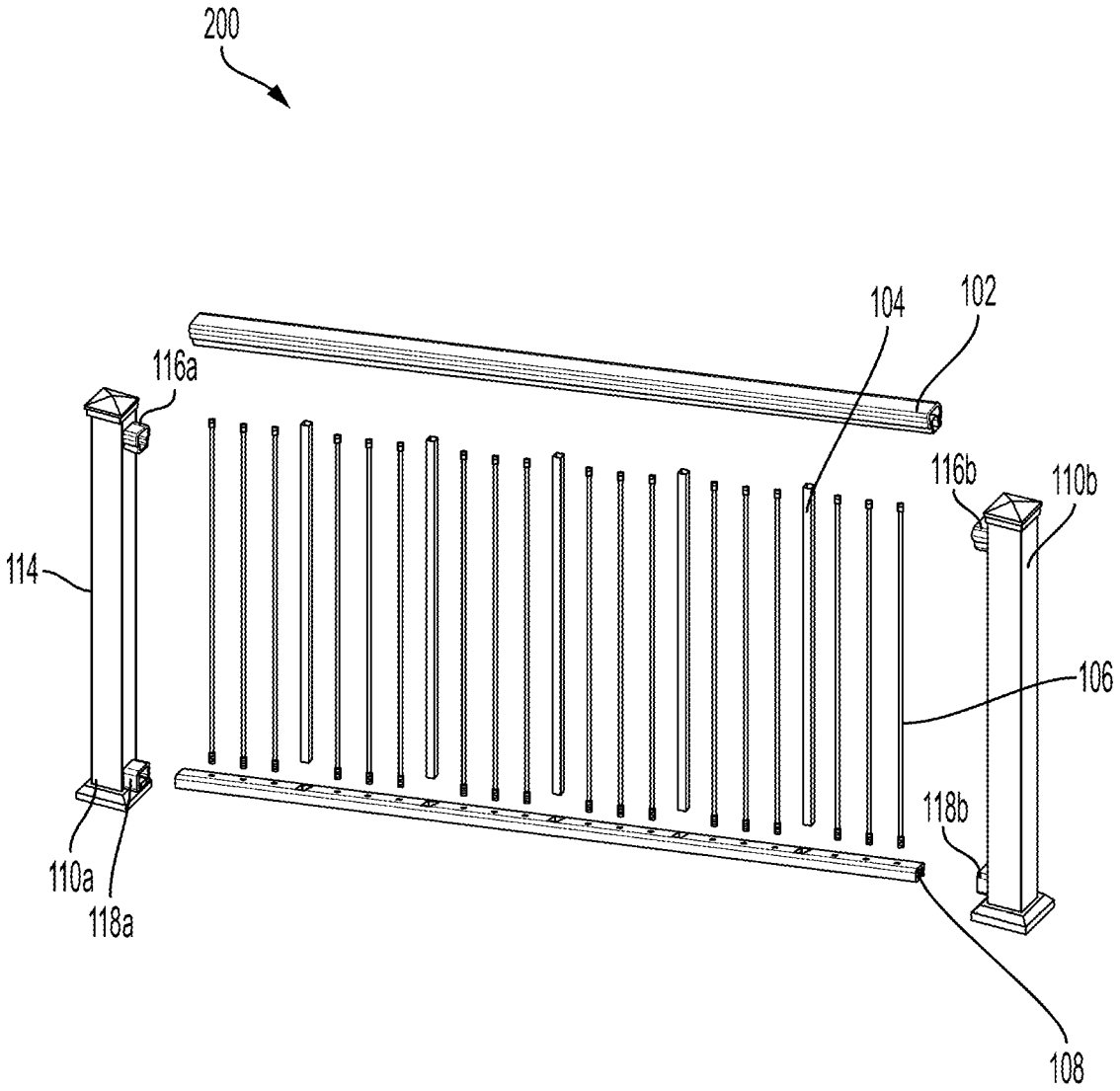
FIG. 2 is an example exploded schematic of the vertical infill railing system/assembly of FIG. 1, detailing exemplary components.
Figure 3:
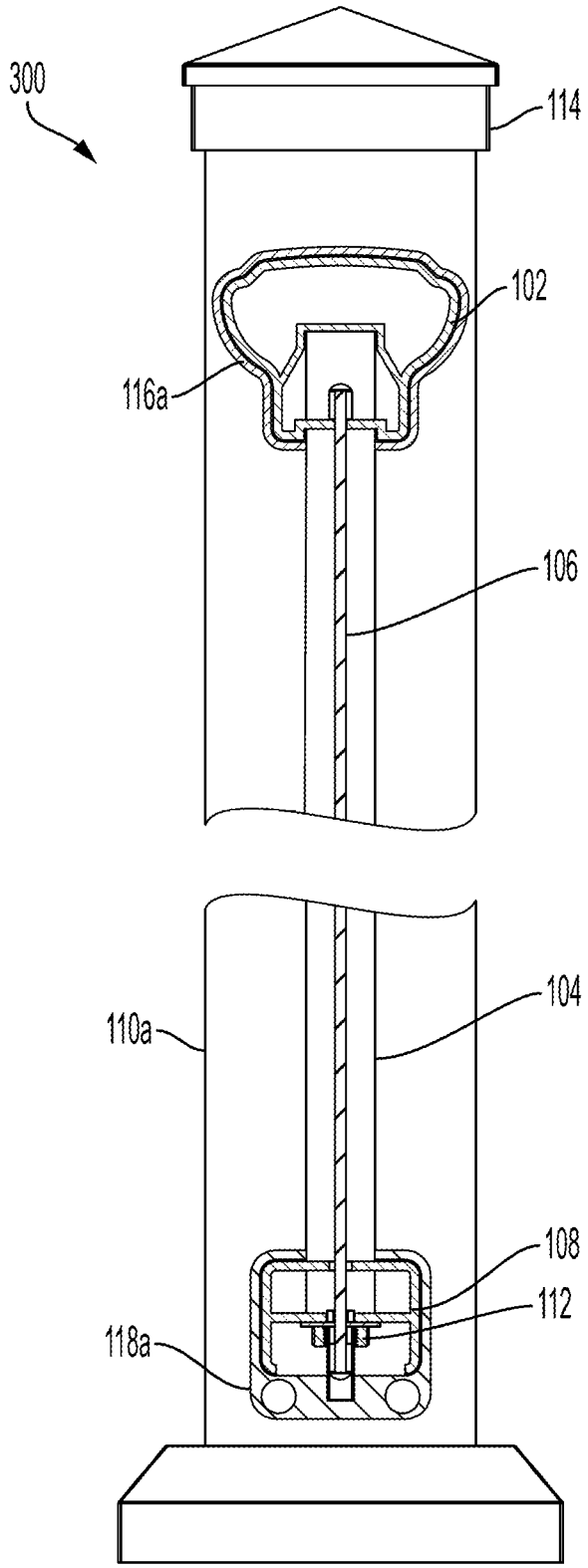
FIG. 3 is a sectional view of the assembly of FIG. 2, illustrating an exemplary upper bracket and lower bracket.

FIG. 1 is an example schematic 100 of a vertical infill railing system/assembly 114 when assembled in a linear environment. FIG. 2 is an example exploded schematic 200 of the vertical infill railing system/assembly 114, detailing its individual components. In FIG. 1, upper horizontal handrail 102 and lower foot rail 108 may be attached to vertical posts 110*a* and 110*b* with receiving brackets along the A-axis. For example, these receiving brackets can include upper handrail brackets 116*a*, 116*b* and/or lower foot rail bracket 118*a*, 118*b*, as shown in FIGS. 2 and 3. In some embodiments, railing posts 110*a* and 110*b* may be mounted on a deck surface or other walkway to provide a ridged upright support. Vertical infill cables 106 may be attached to the upper 102 and lower rails 108, and can form a guard fence, as illustrated in FIG. 1. When secured through the lower foot railing 108, and thereby tensioned via 112, the infill cables 106 may create a tight stiff member. Compression baluster members 104 may also be attached to the upper 102 and lower railings 108 to prevent the railings 102 and/or 108 from bending due to the infill cable 106 tension loads.

Figure 9:
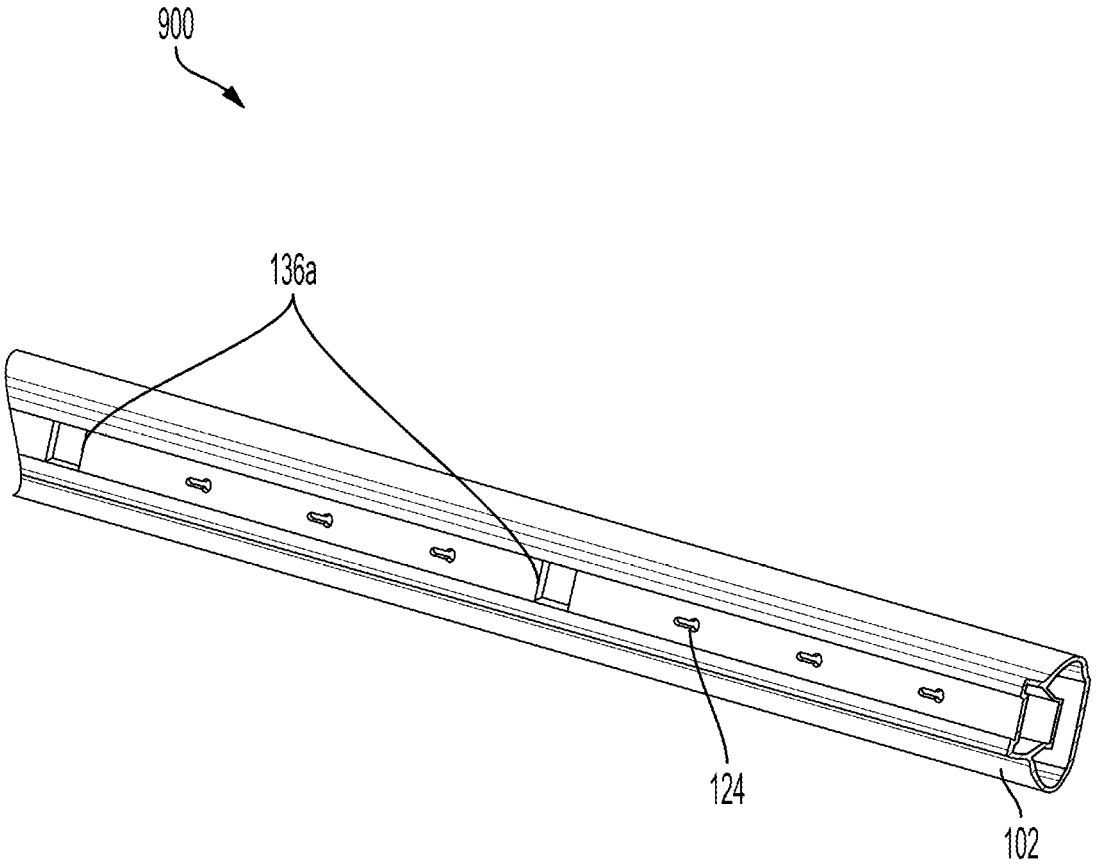
FIGS. 9 and 10 include perspective views of the upper railing and lower railing of the assemblies of the present disclosure.

FIG. 3 is a sectional view 300 of the assembly 114, illustrating upper bracket 116*a* and lower bracket 118*a*. Although these components of post 110*a* are detailed, a similar sectional view of post 110*b*, upper bracket 116*b*, and lower bracket 118*b*, is included in the present disclosure. In FIG. 3, upper 116*a* and lower 118*a* brackets are mounted to post 110*a* to receive the ends of the corresponding upper 102 and lower 108 railings, as well as fixedly restraining them within assembly 114. Infill tension member assemblies 106 can be secured within lower foot rail 108 via infill tension device 112 to create a tight stiff member. Lower compression members 104 may be secured within lower foot rail 108 via slots 136, as shown in FIG. 9.

Figure 4:
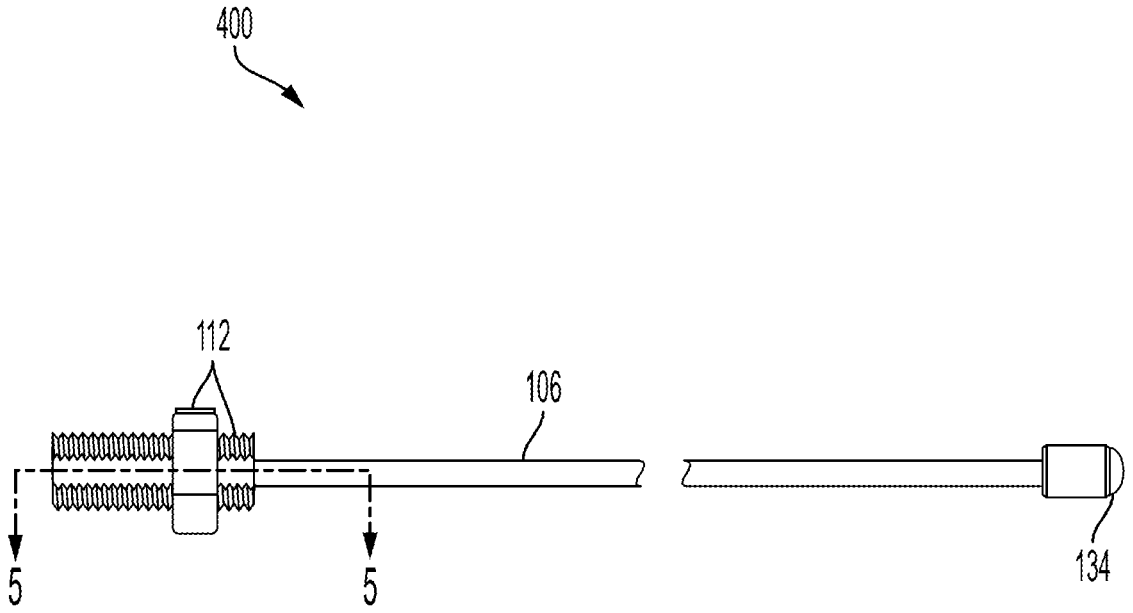
FIG. 4 is a perspective view of an infill cable member of the assembly of FIG. 3.

FIG. 4 is a perspective view 400 of an infill cable member 106 of assembly 114 along a B-axis. This can include infill tension device 112, as previously introduced, which can reside within lower foot rail 108 to secure infill cable members 106. Further, cable members 106 can be secured within an upper railing 102 via upper stop sleeves 134. In some embodiments, these stop sleeves may be welded to the upper end of an infill cable member 106.

Figure 5:
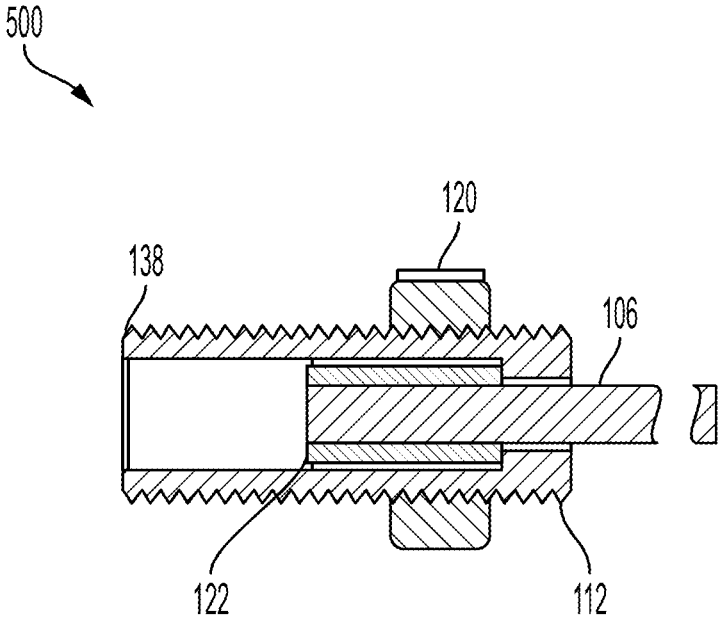
FIG. 5 is a perspective section view of the infill tensioning device of the assembly of FIG. 4.
Figure 6A:
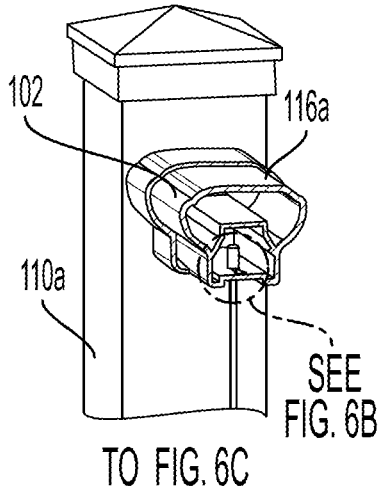
FIG. 6 is a perspective sectional view of the assembly of FIG. 5 in loaded tension position, illustrating an exemplary post, along with zoomed-in exemplary views of the upper bracket and lower bracket of the post.
Figure 6B:
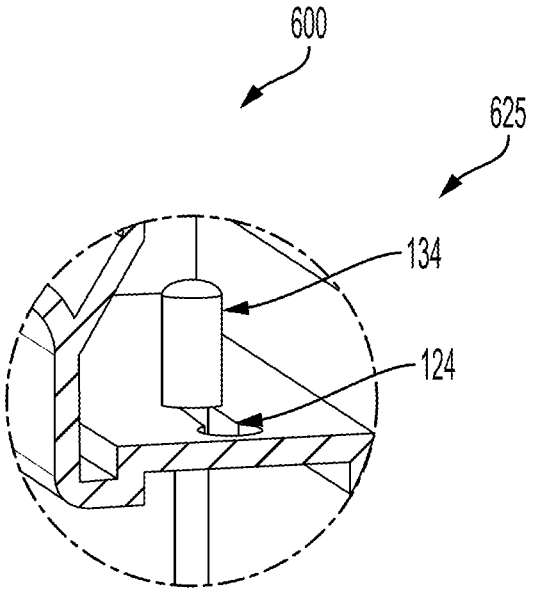
Figure 6C:
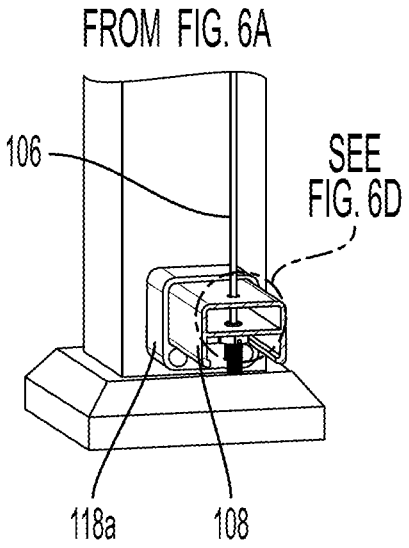
Figure 6D:
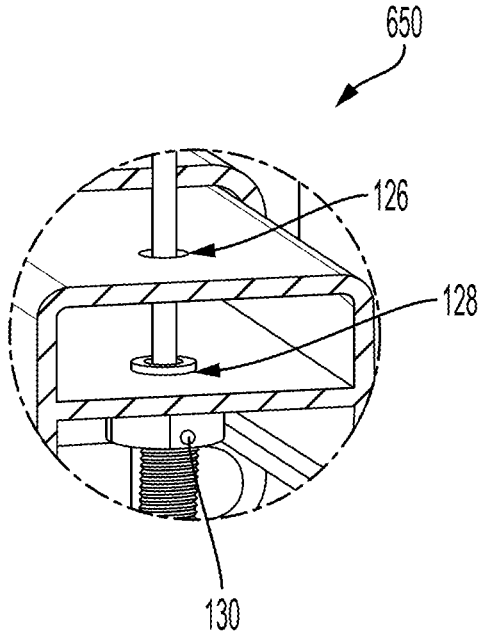

FIG. 5 is a perspective section view 500 of the infill tensioning device 112 of assembly 114. In FIG. 5, the lower end fitting consists of a tensioning mechanism 112, which may secure an infill cable 106 within lower foot rail 108 via nut 120 and lower stop sleeve 122. For example, an externally threaded tube 138 and hex nut 120 may provide a mini turnbuckle for tensioning the infill cable 106. A stop sleeve 122 may be attached to the lower end of the cable 106 and seats inside the threaded tube 138. The tube 138 may have flats on two sides, as illustrated in FIG. 4, to provide anti-rotation during tightening of the nut 120.

Figure 7:
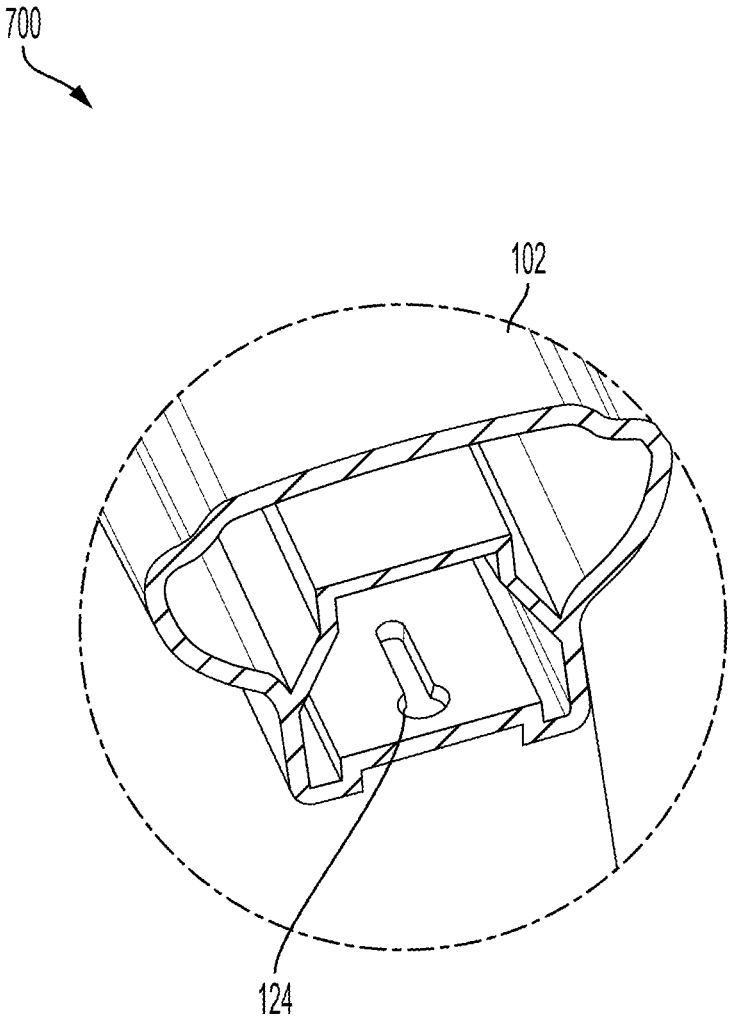
FIG. 7 is a zoomed-in perspective view of an exemplary upper railing of the assembly of FIG. 6.

FIG. 6 includes a perspective sectional view 600 of the assembly 114 in loaded tension position, illustrating post 110*a*, along with zoomed-in views 625 and 650 of the upper bracket 116*a* and lower bracket 118*a* of post 110*a*. Again, although these components of post 110*a* are detailed, a similar sectional view of post 110*b*, upper bracket 116*b*, and lower bracket 118*b*, is included in the present disclosure. FIG. 6 illustrates an exemplary manner in which infill cable member 106 may be secured within and to upper railing 102 and lower railing 108 within assembly 114. For example, cable members 106 can be secured within an upper railing 102 via upper stop sleeves 134, as shown in view 625. Loading slot 124 may include an aperture and/or hole large enough for the cable 106 and/or stop sleeve 134 to pass though during infill cable 106 installation. Cable 106 may then be moved away from the loading slot 124 in order to be secured in place within upper railing 102 via stop sleeve 134. As shown in view 700 of FIG. 7, in some embodiments, the attachment slot 124 of upper rail 102 may receive the upper stop sleeve 134 through a hole portion of diameter slightly greater than the sleeve 134 before being slid into a narrower part of the slot 124, which may be about the width of the cable 106. In some embodiments, the slot 124 spacing is the same distance on upper 102 and lower 108 rails to provide proper vertical alignment within assembly 114.

Figure 8:
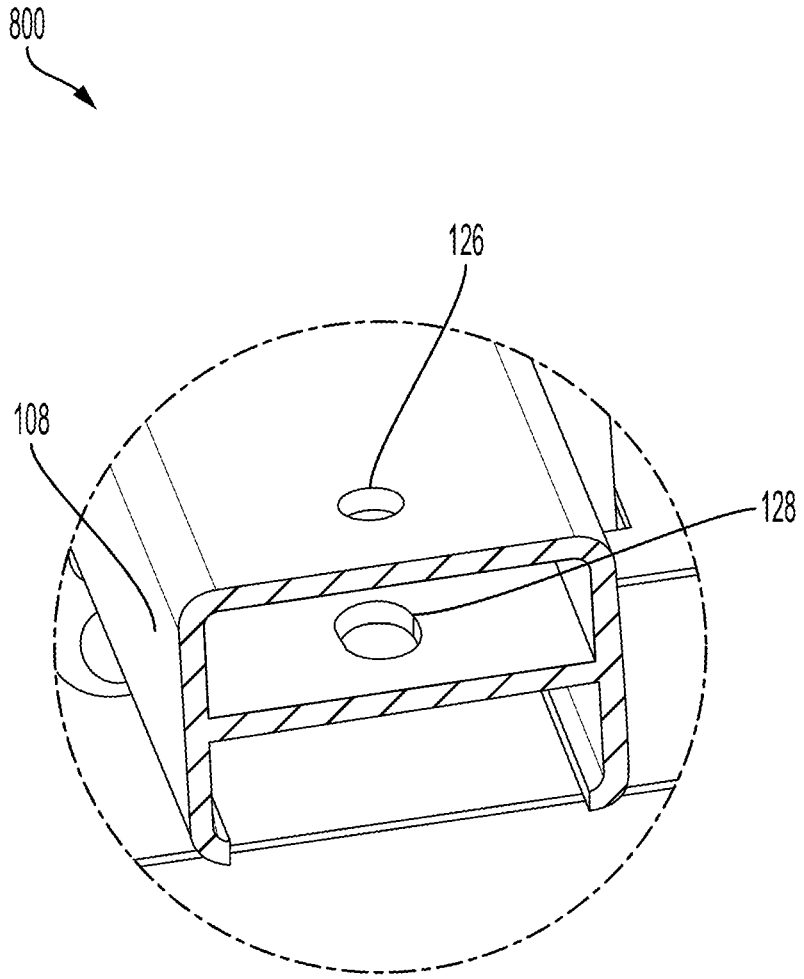
FIG. 8 is a zoomed-in perspective view of an exemplary lower railing of the assembly of FIG. 6.

Also shown in FIG. 6, lower railing 108 may include loading hole 126, as shown in view 650, through which cable 106 may pass and be secured as presented in FIG. 5 via tension nut 120. Further lower railing 108 may include an anti-rotation slot 128 disposed between device 112 and loading hole 126 in order to further secure cable 106 within lower railing 108 and assembly 114. For example, this slot 128 may include flats. This can be shown in detail in view 800 of FIG. 8, which reiterates that the larger hole of the slot 124 may match the diameter of 126 so that stop sleeve 134 may pass through into 124. For example, the narrower part of 124 may more closely match the diameter of cable 106. Cable 106 may be also secured within assembly 114 as it mates with flats on the tensioner 112 sleeve, thereby further preventing rotation.

Figure 10:
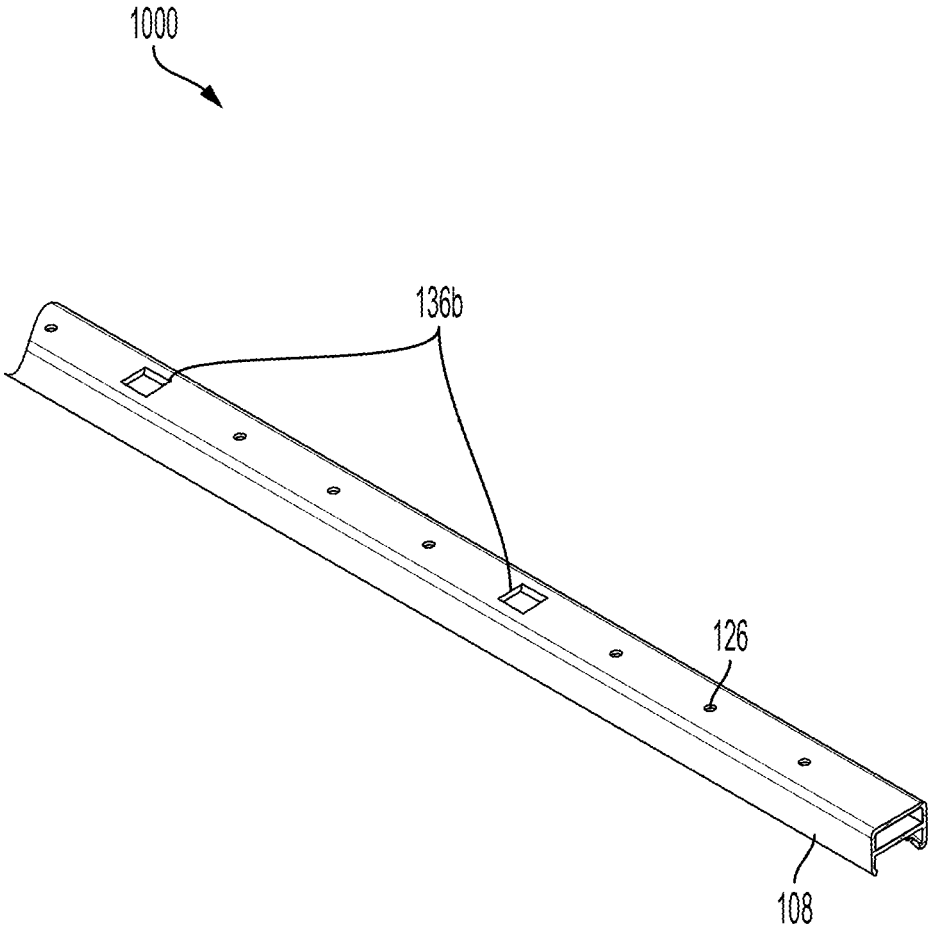

FIGS. 9 and 10 include perspective views 900 and 1000 of the upper railing 102 and lower railing 108 of assembly 114. FIGS. 9 and 10 illustrate slots 124 and 126, which as previously discussed, may secure and tension cables 106. These Figures also present slots 136*a* and 136*b*, which may be used to secure baluster compression supports 104 throughout assembly 114. In some embodiments, compression support balusters 104 may be used in quantities as required to prevent the upper 102 and lower 108 railings from bending due to infill cable 106 tensioning. The balusters 104 may generally be square-shaped and installed in slots 136*a* in the underside of the upper rail 102, as shown in view 900, or slots 136*b* in the topside of the lower railing 108, as shown in view 1000. Once support balusters 104 are secured within slots 136*a* and 136*b*, they may contact the opposing surfaces to provide a load bearing surface within assembly 114. In some embodiments, the balusters 104 are captivated in slots 136*a* and 136*b* between the rails 102 and 108. The slots 136*a* and 136*b* may match the same spacing on both upper and lower rails 102 and 108 to keep the balusters 104 vertical.

Figure 11A:
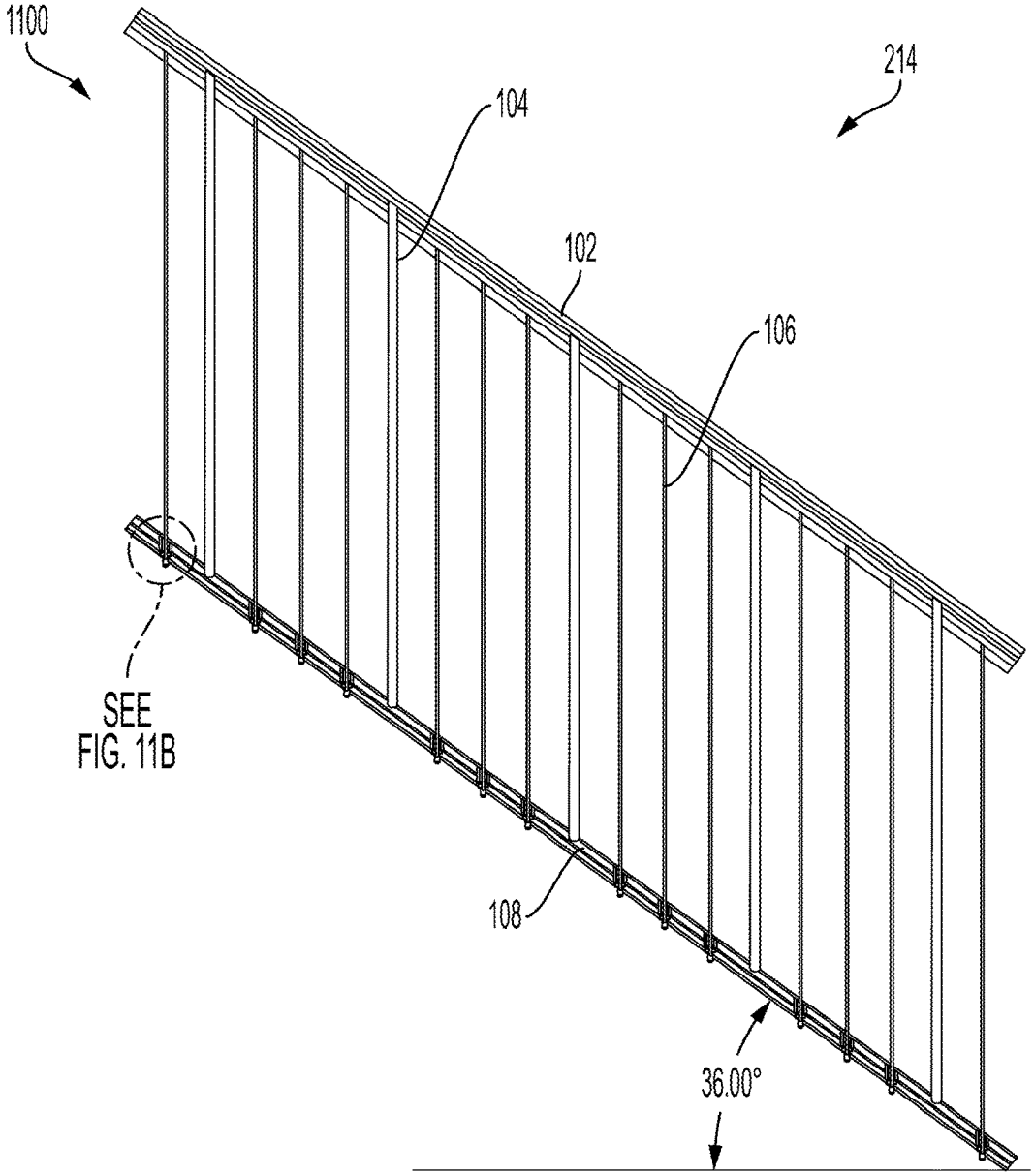
FIGS. 11-13 present perspective views of an exemplary vertical infill railing assembly when assembled in an inclined environment.
Figure 11B:
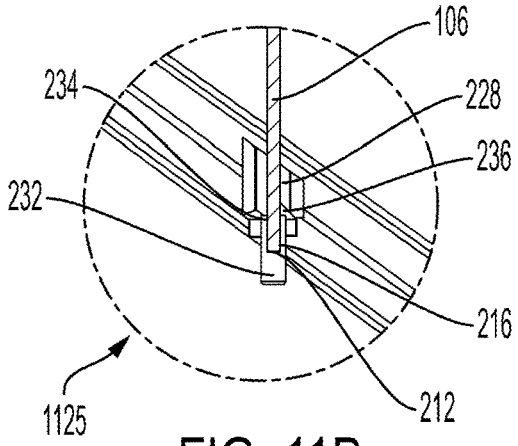
Figure 12:
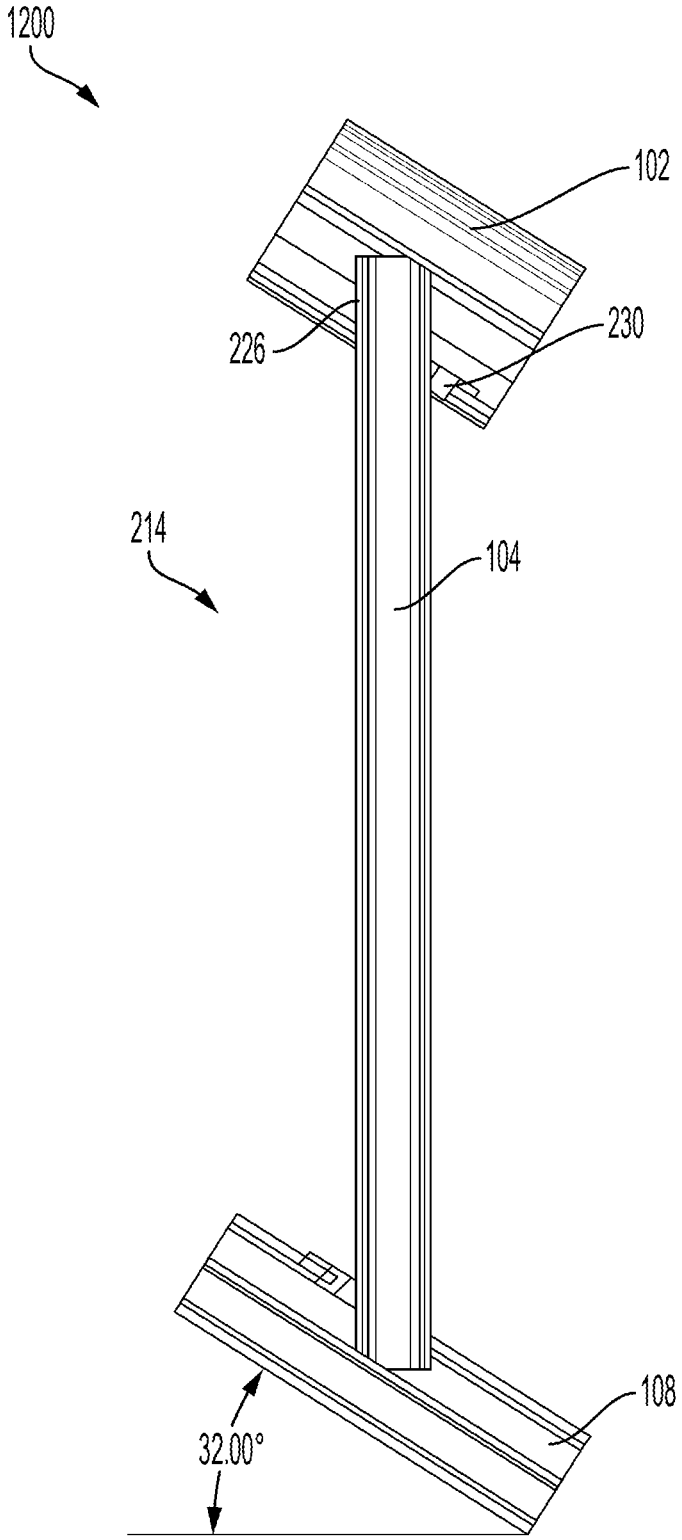
Figure 13:
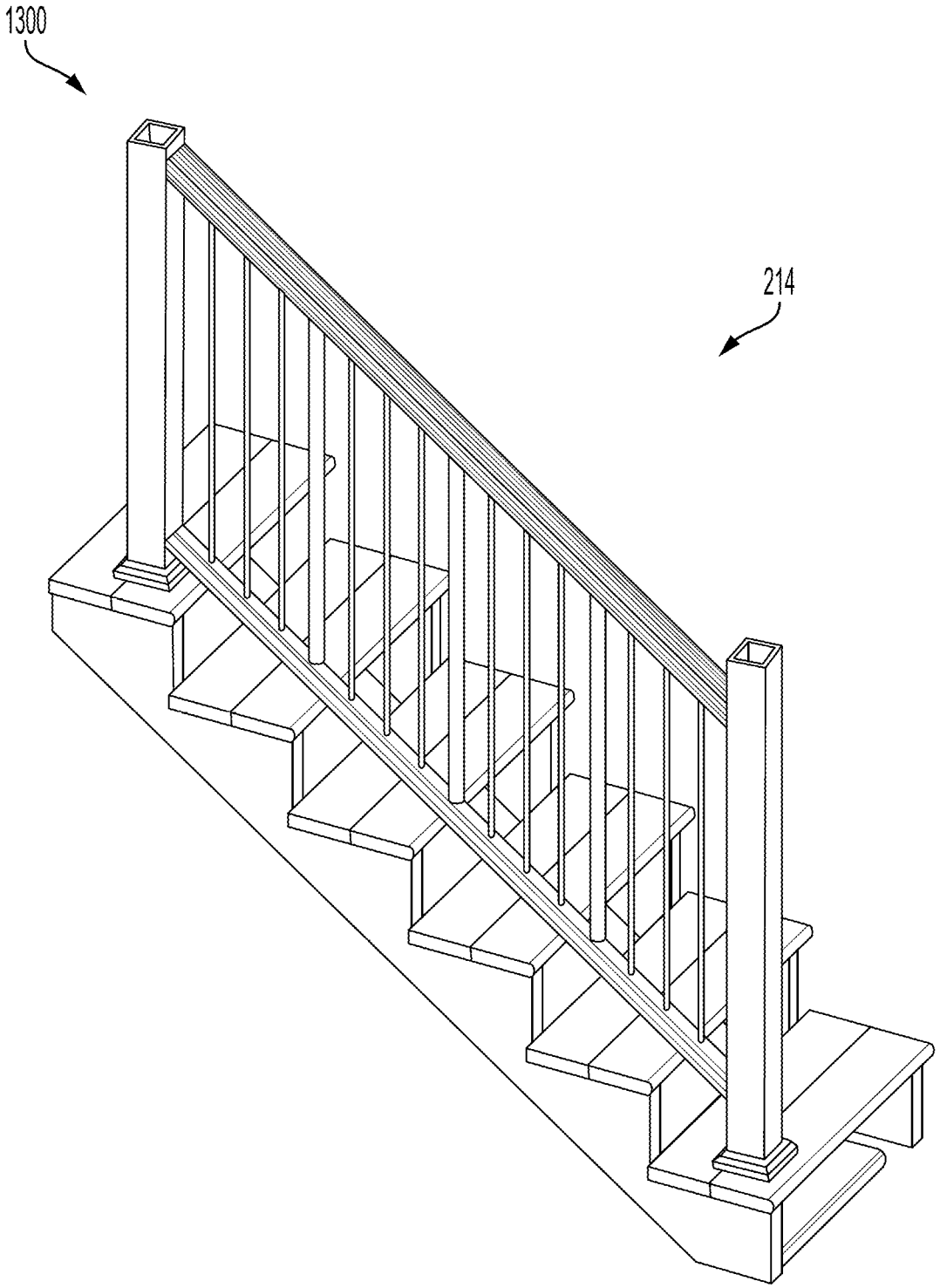

FIGS. 11-13 present perspective views 1100-1300 of the exemplary vertical infill railing system/assembly 214 when assembled in an inclined environment, such as a staircase. Inclined assembly 214 may otherwise be similar to linear assembly 114 and/or work in a similar fashion as previously presented. In some examples, inclined assembly 214 may be slightly longer than linear assembly 114. In assembly 214, upper and lower rails 102 and 108 may be the same shape as their counterparts in assembly 114.

In some embodiments, lower railing 108 slots 228 may be slightly longer from 126 and 128 to accommodate various inclining angles of assembly 214 depending upon its environment. This can include beveled spacer 232, as shown in view 1125 of FIG. 11. For example, spacer 232 may be accompanied by washer 234. A lower stud 236 may also be present alongside spacer 232 in lower railing 108 to secure cable 106 to railing 108 within assembly 114. Spacer 232, washer 234, and stud 236 may thereby function similarly to tensioning device 112, and be referred to collectively as angular bottom tensioner 212. In embodiments, similar to tensioning device 112 of assembly 114, cable 106 with tubular tensioner 212 may pass through beveled spacer 232. As shown in view 1125 of FIG. 11, the flats 214 on tensioner 212 may contact the outer flats 216 in the spacer 232 to apply tension from the bottom throughout each cable 106. As with tensioner 112, the presence of spacer 232 may thereby assist tensioner 212 to prevent rotation in linear railing 108 while tensioning. Cable 106 ends may further be attached, via welding, gluing, or like methods, to stop sleeves in railings 102 and/or 108 to further provide stability and tension in assembly 214. In embodiments, once in the slots 226 and 232, cables 106 may contact the opposing surfaces of rails 102 and 108 to provide a load bearing surface. The balusters 104 may be similarly tensioned and captivated in slots 228*a* and 228*b* between the rails 102 and 108. The slots may match the same spacing on both upper and lower rails 102 and 108 to keep balusters 104 vertical.

As shown in perspective view 1200 of FIG. 12, assembly 214 can include plastic insert 230, which can allow for different angular openings in the upper railing 102 baluster slots 226. As previously introduced, upper rail 102 of assembly 214 may function otherwise the same as the linear upper rail 102 of assembly 114, with a stop sleeve resting inside as the baluster 104 passes through slot 226. In embodiments, this may include 32-39 degree capacities of inclination; for example, view 1100 of FIG. 11 shows a 36 degree angle of inclination of inclined assembly 214, and view 1200 of FIG. 12 shows a 32 degree angle of inclination of inclined assembly 214. As shown in perspective sectional view 1125, plastic stabilizer insert 230 may fit through the rail 108 slots and contacts the inside.

In embodiments, railings systems such as 114 and/or 214 can be assembled on or off the posts before the members 104 and/or cables 106 are installed between the posts of the present disclosure. Pre-made infill cable assemblies 114 and/or 214 may be installed by inserting an upper stop sleeve 134 first through lower foot railing anti-rotation slot 128 and wire loading hole 126, and then into the hole of loading slot 124 of upper handrail 102, before being slid into the narrower/wire portion of loading/key slot 124. During this exemplary installation process for assemblies 114 and/or 214, once all infill cables 106 are installed, tension applied throughout assembly 114 and/or 214 creates a taught member. Optionally, the cable assemblies 114 and/or 214, along with the support balusters and rails, may be preassembled in a panel assembly by either a manufacturer or installer, then placed between the posts.

Elements of different implementations described may be combined to form other implementations not specifically set forth previously. Elements may be left out of the systems described previously without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A vertical infill railing system assembly, comprising:

one or more vertical infill cables, each having one or more upper stop sleeves welded thereto;

an upper support handrail member, wherein the upper support handrail member receives and supports the one or more vertical infill cables and one or more baluster members, the one or more upper stop sleeves received through a loading slot having a hole portion and a narrower part;

a lower support handrail member, wherein the lower support handrail member receives and supports the one or more vertical infill cables and the one or more baluster members, the lower support handrail member including a loading hole through which the one or more vertical infill cables pass, and an anti-rotation slot disposed adjacent the loading hole; and one or more tensioning devices, wherein the one or more tensioning devices receive and tension the one or more vertical infill cables, the one or more tensioning devices extending through the anti-rotation slot of the lower support handrail member.

2. The vertical railing assembly of claim 1, further comprising two or more posts securing the upper support handrail member and lower support handrail member at opposing upper and lower ends of the two or more posts.

3. The vertical railing assembly of claim 2, wherein the upper support handrail member and lower support handrail member are secured at opposing upper and lower ends of the two or more posts via two or more upper brackets and two or more lower brackets.

4. The vertical railing assembly of claim 1, wherein the upper support handrail member receives and supports an upper end of the one or more vertical infill cables and an upper end of the one or more baluster members.

5. The vertical railing assembly of claim 4, wherein the hole portion has a diameter selected to be greater than a diameter of the one or more upper stop sleeves and the narrower part is about the width of the one or more vertical infill cables.

6. The vertical railing assembly of claim 1, wherein the lower support handrail member receives and supports the one or more tensioning devices and a lower end of the one or more baluster members.

7. The vertical railing assembly of claim 1, wherein the one or more baluster members are compression support balusters to support the tensioning of the one or more vertical infill cables.

8. The vertical railing assembly of claim 7, wherein the one or more baluster members are installed in one or more respectively opposing baluster support slots on the upper support handrail member and lower support handrail member to support the tensioning of the one or more vertical infill cables.

9. The vertical railing assembly of claim 8, wherein supporting the tensioning of the one or more vertical infill cables prevents bending of the upper support handrail member and lower support handrail member.

10. The vertical railing assembly of claim 1, wherein the one or more tensioning devices are disposed within the lower support handrail member.

11. The vertical railing assembly of claim 10, wherein the one or more tensioning devices tension the one or more vertical infill cables via one or more lower stop sleeves and one or more externally threaded tubes.

12. The vertical railing assembly of claim 11, wherein the externally threaded tube provides a turnbuckle for tensioning the one or more vertical infill cables.

13. The vertical railing assembly of claim 12, wherein the externally threaded tube surrounds the one or more lower stop sleeves, which is attached to a lower end of the one or more vertical infill cables.

14. The vertical railing assembly of claim 13, wherein the externally threaded tube is flat on two or more external sides to provide anti-rotation of the one or more tensioning devices.

15. The vertical railing assembly of claim 1, wherein the one or more vertical infill cables have at least one end fitting glued or mechanically attached thereto, the at least one end fitting received within the lower support handrail member.

16. The vertical railing assembly of claim 15, wherein the one or more vertical infill cables are bonded directly to the one or more upper stop sleeves.

17. The vertical railing assembly of claim 1, wherein the one or more vertical infill cables includes a solid rod.

18. The vertical railing assembly of claim 1, wherein the upper support handrail member and lower support handrail member include a rigid tubular and/or semi-tubular structural railing.

19. The vertical railing assembly of claim 1, further comprising an angular bottom tensioner, wherein the angular bottom tensioner receives and tensions the one or more vertical infill cables when the vertical infill railing system assembly is installed in an inclined environment.

20. A vertical infill railing system assembly, comprising:

one or more vertical infill cables, each having one or more upper stop sleeves welded thereto;

an upper support handrail member, wherein the upper support handrail member receives and supports the one or more vertical infill cables, the one or more upper stop sleeves received through a loading slot having a hole portion and a narrower part;

a lower support handrail member, wherein the lower support handrail member receives and supports the one or more vertical infill cables, wherein the one or more vertical infill cables are bonded directly to the one or more upper stop sleeves and one or more lower stop sleeves, the lower support handrail member including a loading hole through which the one or more vertical infill cables pass, and an anti-rotation slot disposed adjacent the loading hole;

two or more posts securing the upper support handrail member and lower support handrail member at opposing upper and lower ends of the two or more posts, wherein the upper support handrail member and lower support handrail member are secured at opposing upper and lower ends of the two or more posts via two or more upper brackets and two or more lower brackets; and one or more tensioning devices, wherein the one or more tensioning devices receive and tension the one or more vertical infill cables via the one or more lower stop sleeves and one or more externally threaded tubes within the lower support handrail member, the one or more tensioning devices extending through the anti-rotation slot of the lower support handrail member.

* * * * *